US005098056A

United States Patent [19]

Alger et al.

[11] Patent Number: 5,098,056

[45] Date of Patent: Mar. 24, 1992

[54] SUPPORT ARRANGEMENT FOR DECORATIVE PLAQUE

[75] Inventors: Andrew L. Alger, Wilnette; Ray Zinn, Bolingbrook, both of Ill.

[73] Assignee: The Norman Rockwell Gallery, Limited, Niles, Ill.

[21] Appl. No.: 674,096

[22] Filed: Mar. 25, 1991

[51] Int. Cl.[5] ..... A47B 97/04

[52] U.S. Cl. ..... 248/463; 248/463; 248/472

[58] Field of Search ..... 248/470, 471, 472, 463, 248/126

[56] References Cited

U.S. PATENT DOCUMENTS

| | | | |
|---|---|---|---|
| 236,371 | 1/1881 | Somers | 248/471 |
| 245,485 | 8/1881 | Haff | 248/471 |
| 250,229 | 11/1881 | Gollner | 248/470 |
| 253,457 | 2/1882 | Wiederer | 248/471 |
| 1,113,034 | 10/1914 | Miller | 248/470 |
| 3,251,572 | 5/1966 | Klitzner | 248/470 X |
| 3,990,670 | 11/1976 | Frechtman | 248/470 |
| 4,290,216 | 9/1981 | Gale | 248/470 X |

FOREIGN PATENT DOCUMENTS

| | | | |
|---|---|---|---|
| 0515376 | 8/1955 | Canada | 248/470 |
| 0005827 | of 1888 | United Kingdom | 248/470 |
| 0029372 | of 1913 | United Kingdom | 248/472 |

*Primary Examiner*—J. Franklin Foss

*Attorney, Agent, or Firm*—Dressler, Goldsmith, Shore, Sutker & Milnamow, Ltd.

[57] ABSTRACT

A dual position support arrangement for a decorative plaque or other associated object includes a support bracket which can be attached to a rearwardly facing surface of the article, and a support loop movably connected to the support bracket. The support loop is movable between a first lower position, wherein the article can be supported in a generally upright position, and a second upper position wherein the article can be supported by hanging from the support loop. The support loop includes at least one locking element which cooperates with the support bracket for releasably retaining the support loop in either of its upper or lower positions.

6 Claims, 2 Drawing Sheets

SUPPORT ARRANGEMENT FOR DECORATIVE PLAQUE

BACKGROUND OF THE INVENTION

The present invention relates generally to arrangements for supporting decorative plaques, collector plates, picture frames and the like, and more particularly to a dual position support arrangement for an associated article such as a decorative plaque, which arrangement permits the article to be supported in a free-standing, upright position, or conveniently hung from an associated vertical surface.

BACKGROUND OF THE INVENTION

Artistic and decorative objects such as collector's plates, decorative plaques, photographs, and paintings, are preferably displayed in a fashion that places the object in a generally upright or vertical orientation. If an object of this nature is to be displayed on a horizontal surface, such as a shelf or desk, it is usually necessary to provide a separate easel-like support device. If the object is to be hung from a wall or other vertical surface, a suitable wire or other support element must be secured to the rearward surface of the article, thereby permitting the article to be suspended from a suitable hanging device or nail. In most instances, a construction which permits the article to be supported upon a horizontal surface does not facilitate hanging, or vice versa.

SUMMARY OF THE INVENTION

The present invention contemplates a dual position support arrangement for an associated article such as a decorative plaque, collector plate, picture frame, or the like, which provides desirable versatility for display of the article. By virtue of its dual position nature, the present support arrangement permits the associated article to be either supported in a free-standing, generally upright position on a horizontal surface, or to be supported by hanging from a wall or other vertical surface. This desirable versatility is provided by a construction which is stable in use and easy to change between its two positions, and which can be readily integrated and permanently affixed to an associated article.

In accordance with the illustrated embodiment, the present support arrangement includes a unitary support bracket attachable to a rearwardly facing surface of the associated decorative plaque, collector plate, or other article. The bracket includes upper and lower attachment portions each attachable to the associated article, and a central loop-receiving region intermediate the upper and lower attachment portions. The loop-receiving region projects from a common plane defined by the upper and lower attachment portions, and defines a loop-receiving opening.

The present arrangement further includes a support loop movably connected to the support bracket. The support loop includes a pair of journal portions extending along a common axis, with the journal portions joined together by a loop-like strut portion. The support loop is preferably formed from a single metallic wire element, and by this construction, the journal portions are movable toward each other by resiliently flexing the strut portion. The journal portions of the support loop are rotatably received within the loop-receiving region of the support bracket for movement of the support loop between its two positions. In the preferred form, the support bracket comprises a double thickness of material, including a backing layer spanning the loop-receiving region. The support loop is thus movably connected to the support bracket by the captive disposition of the journal portions in the loop-receiving region.

In accordance with the present invention, the support loop of the construction includes at least one locking element extending generally at a right angle from a respective one of the journal portions, with the locking element extending through the loop-receiving opening of the support bracket. In the illustrated embodiment, a pair of the locking elements are provided respectively extending generally at right angles from the pair of journal portions of the support loop.

In accordance with the invention, at least one of the locking elements cooperates with the support bracket, by resiliently flexing the strut portion of the support loop, so that the locking element acts to releasably retain the support loop in a selected one of:

(1) a first lower position of the support loop to permit the associated article to be supported in a generally free-standing, upright position by the support loop, and (2) a second upper position of the support loop to permit the associated article to be supported by hanging by the support loop. By virtue of the movable connection of the support loop to the support bracket, the support loop is rotatable relative to the bracket between the first and second positions, upon release of the locking element.

The configuration of the loop-receiving opening of the support bracket, together with the configuration of the one or more locking elements of the support loop, provide the desired selectively positionable action. In accordance with the illustrated form, the opening defined by the loop-receiving region of the support bracket includes a first generally elongate portion, which is arranged generally horizontally, and a second relatively narrow portion which communicates with and extends generally upwardly from the center of the elongate portion. In the first lower position of the support loop, the locking element of the support loop is disposed within the elongate portion of the loop-receiving opening.

In order to releasably retain the support loop in its second upper position, the support bracket includes at least one retaining tab which projects rearwardly from the upper attachment portion of the bracket. In the illustrated embodiment, a pair of retaining tabs are provided. By virtue of the resiliently flexible nature of the support loop, the locking elements thereof can be positioned to extend through the second relatively narrow portion of the loop-receiving opening, and respectively releasably retained by the retaining tabs of the bracket. Thus, movement of the loop from the first lower position to the second upper position is effected by flexing the support loop, thereby moving the journal portions toward each other, and moving the locking elements from the ends of the elongate portion of the opening so that the support loop can be relatively rotated upwardly. The locking elements are then positioned beneath the retaining tabs, and the support loop released so that its resilient nature biases the journal portions apart, thereby acting to maintain the locking elements in position beneath the retaining tabs. Movement from the second upper position to the first lower position is achieved in a similar manner by resiliently flexing the support loop.

Other features and advantages of the present invention will become readily apparent from the following detailed description, the accompanying drawings, and the appended claims.

DETAILED DESCRIPTION

Figure 3:
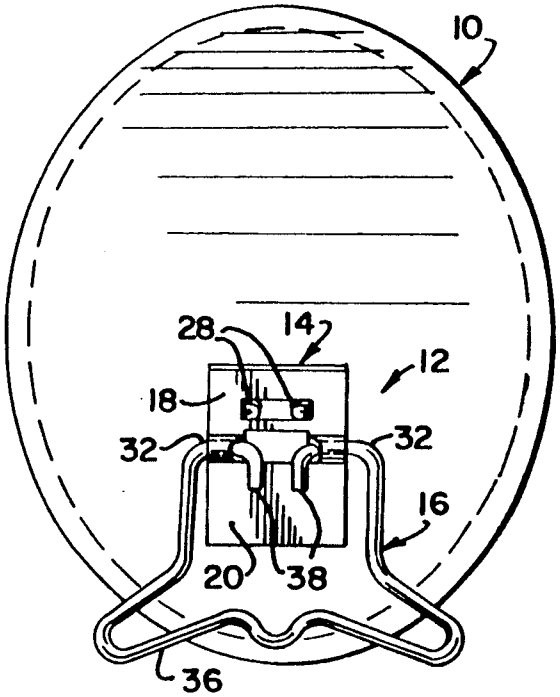
FIG. 3 is a rear elevational view of the decorative plaque and support arrangement illustrated in FIGS. 1 and 2.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference to the drawings, therein is illustrated a decorative plaque 10 having a support arrangement 12 embodying the principles of the present invention. As will be appreciated, a support arrangement 12 in accordance with the present disclosure can be used in association with a wide variety of articles, such as decorative collector plates, picture frames for photographs or paintings, and the like.

Figure 2:
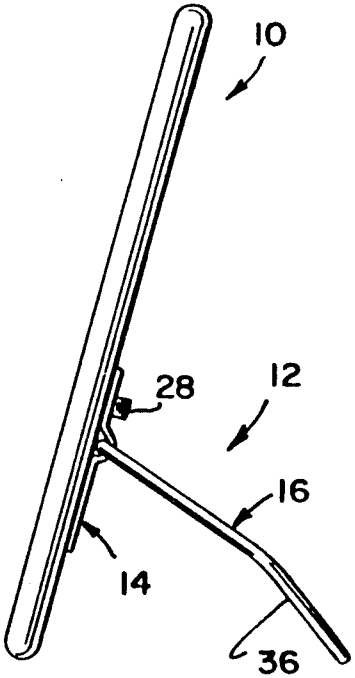
FIG. 2 is a side elevational view of the decorative plaque and support arrangement illustrated in FIG. 1.
Figure 1:
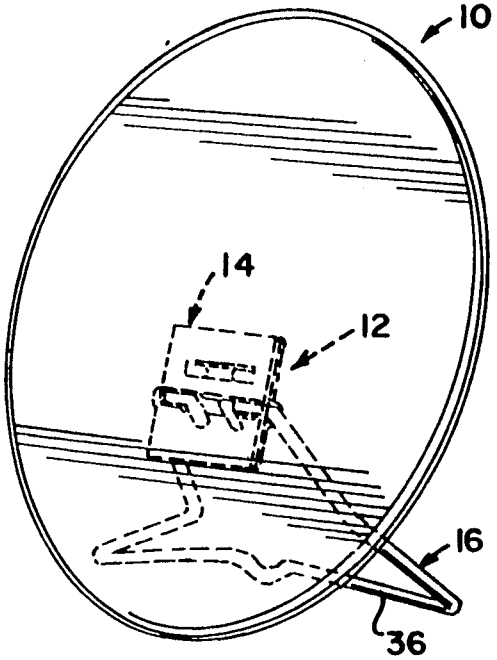
FIG. 1 is a front perspective view of a decorative plaque having a support arrangement embodying the principles of the present invention, wherein the support arrangement is positioned for supporting the plaque in a free-standing position on a horizontal surface.
Figure 4:
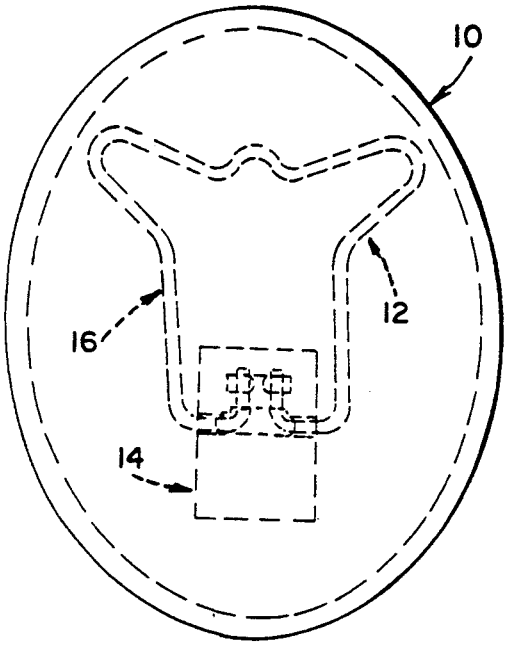
FIG. 4 is a front elevational view illustrating, in phantom line, the present support arrangement in position for supporting the associated decorative plaque by hanging.
Figure 5:
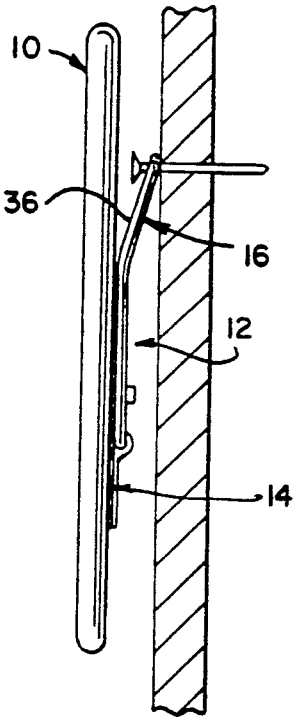
FIG. 5 is a side elevational view illustrating the decorative plaque and support arrangement being supported by hanging on an associated wall.

The support arrangement 12 is desirably straightforward in configuration, and is particularly versatile in that it permits the decorative plaque 10 to be supported in either a free-standing, generally upright position on an associated horizontal surface (such as illustrated in FIGS. 1-3), or to be supported by hanging (as shown in FIGS. 4 and 5) depending upon the position in which the support arrangement is placed. To this end, the arrangement includes a support bracket 14 which can be attached to a rearwardly facing surface of the decorative plaque 10 or other associated article, and a support loop 16 connected to the support bracket for relative movement, as will be described.

Figure 6:
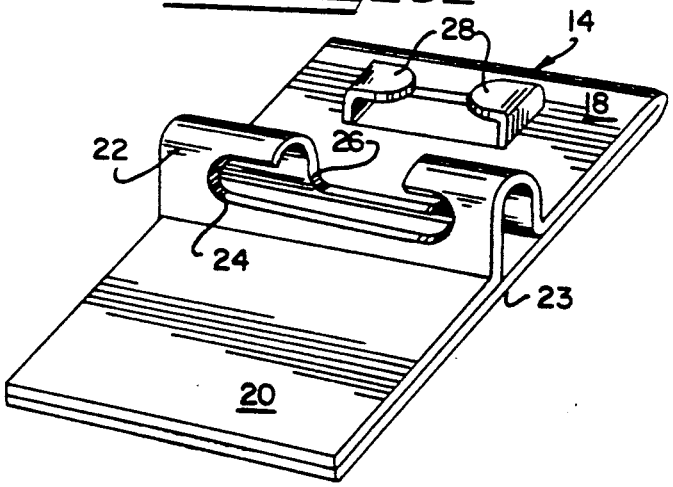
FIG. 6 is a perspective view of a support bracket of the present support arrangement.
Figure 7:
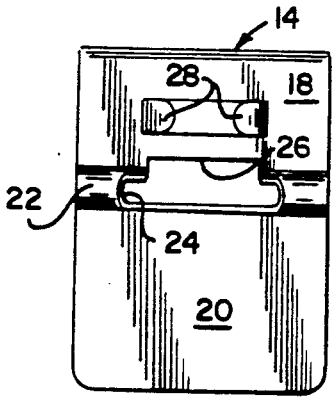
FIG. 7 is a top plan view of the support bracket illustrated in FIG. 6.

With particular reference to FIGS. 6 and 7, the support bracket 14 is preferably of a unitary, one-piece configuration, and can be conveniently formed from stamped metallic material, molded plastic, or the like. The bracket includes upper and lower attachment portions 18 and 20, and a central loop-receiving region 22 therebetween. The loop-receiving region 22 projects from a common plane defined by the upper and lower attachment portions, and is preferably of a generally channel-like cross-section.

In the illustrated embodiment, the support bracket comprises a double thickness of metallic material, folded under itself to define a backing layer 23 positioned adjacent the associated article 10. Preferably, the backing layer is secured in this folded disposition such as by spot-welds at lower attachment portion 20, with the backing layer spanning and closing the loop-receiving region 22. The support loop 16 is thus held in captive relationship within the loop-receiving region 22, desirably facilitating attachment of the support bracket and support loop, as a preassembled unit, to the decorative plaque 10 or other associated article.

The loop-receiving region defines a loop-receiving opening including a first generally elongate portion 24, and a second relatively narrow portion 26 communicating with and extending upwardly from the center of the elongate portion 24. The support bracket further includes at least one, and preferably a pair of retaining tabs 28 preferably formed integrally with and projecting from the upper attachment portion 18 in generally opposed relationship. As will be further described, the retaining tabs 28 cooperate with the support loop 16 to position the support loop for hanging the decorative plaque from a wall or other vertical surface.

In order to movably connect the support loop 16 to the support bracket 14, the support loop includes a pair of laterally spaced journal portions 32 which extend along a common axis about which the support loop is rotatable relative to the support bracket. The support loop further includes a generally loop-like strut portion 34 which joins the journal portions together. By virtue of the preferred metallic wire construction of the support loop, the journal portions are movable toward each other by manually resiliently flexing the strut portion 34. By virtue of the resilient nature of the support loop, the journal portions are ordinarily biased generally away from each other.

The journal portions 32 are rotatably received within the loop-receiving region 22 of the support bracket 14, and are captively held therein by backing layer 23. Thus, the support loop is movably connected to the support bracket by virtue of the captive disposition of the journal portions 32 generally within the loop-receiving region 22.

In accordance with the present invention, the support loop 16 is movable relative to the support bracket 14 between a first lower position, shown in FIGS. 1-3, and a second upper position shown in FIGS. 4 and 5. In this second upper position, the support loop is positioned so that the decorative plaque can be supported by hanging, such as by a suitable nail or the like. To this end, the strut portion 34 of the support loop preferably includes an angled hanging portion 36 spaced from the journal portions 32, and oriented such that the hanging portion is spaced from the rearwardly facing surface of the associated article when the support loop is in its second upper position. The article is thereby stably supported in this position, with the face of the article oriented substantially vertically for attractive display.

The support loop 16 and the support bracket 12 cooperate to releasably retain the support loop in a selected one of either its upper and lower position. While it is within the purview of the present invention to configure the support loop and bracket such that strut portion 34 coacts with the bracket for locking, the provision of separate locking elements is presently preferred. To this end, the support loop includes at least one, and preferably a pair, of locking elements 38 which extend at right angles from respective ones of the journal portions 32. The locking elements 38 preferably extend generally parallel to the strut portion 34 of the support loop, and are arranged to cooperate with the loop-receiving opening, as well as retaining tabs 28, for selectively positioning the support loop.

Specifically, in the first lower position of the support loop, the resilient nature of the support loop acts to urge the locking elements 38 toward respective opposite ends of the elongate portion 24 of the loop-receiving opening (see FIG. 3). In this disposition, the locking elements act to retain the support loop against rotation relative to the support bracket, whereby the associated article can be securely and stably supported in a generally upright position.

In order to position the support loop 16 for hanging of the construction, the support loop can be resiliently flexed so that the journal portions 32 and locking elements 38 are moved toward each other. Once the locking elements have been moved sufficiently closely together, the support loop can be relatively rotated, whereupon the locking elements are moved into the relatively narrow portion 26 of the loop-receiving opening in the bracket. As will be appreciated, this narrow portion 26 is sized to be at least as wide as the combined thickness of the locking elements 38, but is still sufficiently narrow so that the region 22 defines, at the junction of narrow portion 26 with the elongate portion 24, the pair of shoulder-like regions engaged by the locking elements 38 in the first lower position of the support loop.

Upon relative rotation of the support loop 16 to its second upper position, the locking elements 38 are manipulated so as to be respectively positioned beneath the retaining tabs 28, and the support loop released. By virtue of its resilience, release of the support loop urges the locking elements laterally outwardly, thus acting to firmly respectively seat the locking elements 38 in position beneath the retaining tabs 28. The support loop is now firmly, yet releasably, retained in its upper position so that the decorative plaque or like article can be conveniently supported by hanging from the support loop.

When it is desired to move the support loop back to its lower position, the loop can again be readily flexed, thereby moving the locking elements 38 out from beneath the retaining tabs, and the support loop rotated downwardly. The resilience of the support loop acts to thereafter bias the locking elements 38 toward respective opposite ends of the elongate portion 24 of the loop-receiving opening in the bracket.

From the foregoing, it will be observed that numerous modifications and variations can be effected without departing from the true spirit and scope of the novel concept of the present invention. It is to be understood that no limitation with respect to the specific embodiment is intended or should be inferred. The disclosure is intended to cover by the appended claims all such modifications as fall within the scope of the claims.

What is claimed is:

1. A dual position support arrangement for an associated article such as a decorative plaque, collector plate, or picture frame, said support arrangement comprising:

a unitary support bracket attachable to a rearwardly facing surface of said associated article, said bracket including upper and lower attachment portions each attachable to said associated article, said bracket further including a central loop-receiving region intermediate said upper and lower attachment portions, said loop-receiving region projecting integrally from a common plane defined by said upper and lower attachment portions, and defining a loop-receiving opening;

said loop-receiving region having a generally channel-like cross-section open in a direction toward said associated article, said support bracket comprising a double thickness of material including a backing layer spanning and closing the channel-like cross-section of said loop-receiving region; and a support loop movably connected to said support bracket, said support loop including a pair of journal portions extending along a common axis and joined together by a loop-like strut portion of said support loop, said journal portions being movable toward each other by resiliently flexing said strut portion, said journal portions being rotatably received within said loop-receiving region of said support bracket and held in captive relationship therein by said backing layer, said support loop further including locking means, separate from said loop-like strut portion, extending generally at a right angle from at least one of said journal portions, and through said loop receiving opening of said support bracket, said support bracket including retaining tab means projecting rearwardly from one of said attachment portions for releasably retaining said locking means, said locking means retaining said support look in movably connected relationship with said support brackets, said locking means cooperating with said support bracket, by flexing of said strut portion, so that said locking means releasably retains said support loop in a selected one of: (1) a first lower position of said support loop to permit said associated article to be supported in a free-standing, generally upright position by said support loop, and (2) a second upper position of said support loop, wherein said locking means is retained by said retaining tab means, to permit said associated article to be supported by hanging by said support loop, said support loop being rotatable relative to said support bracket between said first and second positions upon release of said locking means.

2. A dual position support arrangement in accordance with claim 1, wherein said strut portion of said support loop includes an angled hanging portion spaced from said journal portions, said hanging portion being spaced from the rearwardly facing surface of said associated article in said second upper position of said support loop to facilitate hanging of said article.

3. A dual position support arrangement in accordance with claim 1, wherein said loop-receiving region defines said opening to include a first generally elongate portion, and a second relatively narrow portion communicating with and extending generally upwardly from said elongate portion, said locking means of said support loop being disposed within said elongate portion in said first lower portion of said support loop.

4. A dual position support arrangement in accordance with claim 3, wherein said retaining tab means projects from said upper attachment portion, said locking means extending through said second relatively narrow portion of said loop-receiving opening and being releasably retained by said tab means in said upper position of said support loop.

5. A dual position support arrangement in accordance with claim 4, wherein said locking means comprises a pair of locking elements respectively extending generally at right angles from said pair of journal portions, one of said locking portions being retained by said tab means in said upper position of said support loop.

6. A dual position support arrangement in accordance with claim 5, wherein, said retaining tab means comprising a pair of retaining tabs projecting from said upper attachment portion, said pair of locking portions being respectively retained by said pair of tabs in said upper position of said support loop.

* * * * *